US006130684A

United States Patent [19]

Premnath et al.

[11] Patent Number: 6,130,684

[45] Date of Patent: Oct. 10, 2000

[54] MAINTENANCE STATION FOR AN INK JET PRINTHEAD WITH IMPROVED CAPPING AND WIPING SYSTEM

[75] Inventors: Karai P. Premnath; William L. King, both of Rochester; Thomas R. Binnert, Hammondspot; Paul F. Sawicki, Rochester, all of N.Y.

[73] Assignee: Xerox Corporation, Stamford, Conn.

[21] Appl. No.: 09/208,236

[22] Filed: Dec. 9, 1998

[51] Int. Cl.[7] ..... B41J 2/165

[52] U.S. Cl. ..... 347/30; 347/33

[58] Field of Search ..... 347/30, 29, 33

[56] References Cited

U.S. PATENT DOCUMENTS

| | | | |
|---|---|---|---|
| Re. 32,572 | 1/1988 | Hawkins et al. | 156/626 |
| 4,571,599 | 2/1986 | Rezenka . | |
| 4,638,337 | 1/1987 | Torpey et al. . | |
| 4,679,059 | 7/1987 | Dagna . | |
| 4,746,938 | 5/1988 | Yamamori et al. . | |
| 4,849,774 | 7/1989 | Endo et al. . | |
| 4,855,764 | 8/1989 | Humbs et al. . | |
| 4,863,717 | 9/1989 | Keana | 424/9 |
| 4,970,534 | 11/1990 | Terasawa et al. | 347/29 |
| 5,216,450 | 6/1993 | Koitabashi et al. | 347/86 |
| 5,555,461 | 9/1996 | Ackerman | 347/33 |
| 6,000,779 | 12/1999 | Ng et al. | 347/24 |

*Primary Examiner*—N. Le
*Assistant Examiner*—Shih-wen Hsieh
*Attorney, Agent, or Firm*—David J. Arthur

[57] ABSTRACT

An ink jet printer includes a capping and wiping system in a maintenance station which is connected to a common vacuum source. The wiping system includes a blotter-type collection member which presents an air vent when the printhead is in a capped position. When a priming operation is initiated, the air vent route is blocked, and full pressure is applied at the capping nozzle interface.

3 Claims, 3 Drawing Sheets

MAINTENANCE STATION FOR AN INK JET PRINTHEAD WITH IMPROVED CAPPING AND WIPING SYSTEM

BACKGROUND OF THE INVENTION AND MATERIAL DISCLOSURE STATEMENT

The present invention generally relates to a maintenance station of an ink jet printer and, more particularly, to a capping and wiping system within the maintenance station which is connected to a common vacuum source for more efficient performance.

An ink jet printer of the so-called "drop-on-demand" type has at least one printhead from which droplets of ink are directed towards a recording medium. Within the printhead, the ink may be contained in a plurality of channels and energy pulses are used to cause the droplets of ink to be expelled, as required, from orifices at the ends of the channels.

In a thermal ink jet printer, the energy pulses are usually produced by resistors, each located in a respective one of the channels, which are individually addressable by current pulses to heat and vaporize ink in the channels. As a vapor bubble grows in any one of the channels, ink bulges from the channel orifice or nozzle until the current pulse has ceased and the bubble begins to collapse. At that stage, the ink within the channel retracts and separates from the bulging ink which forms a droplet moving in a direction away from the channel and towards a recording medium. The channel is then refilled by capillary action, drawing ink from a supply container. Operation of thermal ink jet printers are described, for example, U.S. Pat. Nos. 4,849,774 and 4,571,599.

One particular form of thermal ink jet printer is described in U.S. Pat. No. 4,638,337. That printer is of the carriage type and has a plurality of printheads, each with its own ink supply cartridge, mounted on a reciprocating carriage. The channel orifices in each printhead are aligned perpendicular to the line of movement of the carriage and a swath of information is printed on the stationary recording medium as the carriage is moved in one direction. The recording medium is then stepped, perpendicular to the line of carriage movement, by a distance equal to the width of the printed swath and the carriage is then moved in the reverse direction to print another swath of information.

It has been recognized that there is a need to maintain the ink ejecting orifices of an ink jet printer, for example, by periodically cleaning the orifices when the printer is in use, and/or by capping the printhead when the printer is out of use or is idle for extended periods. The capping of the printhead is intended to prevent the ink in the printhead from drying out. There is also a need to prime a printhead before use, to ensure that the printhead channels are completely filled with ink and contain no contaminants or air bubbles. Maintenance and/or priming stations for the printheads of various types of ink jet printers are described in, for example, U.S. Pat. Nos. 4,855,764, 4,863,717 and 4,746,938 while the removal of gas from the ink reservoir of a printhead during printing is described in U.S. Pat. No. 4,679,059. All of these patents are hereby incorporated by reference.

A continuing problem with prior art capping mechanisms is that of positive pressure buildup when the printhead is in a capped condition. In a typical capping operation, a cap comprised of a ribbed membrane is brought into engagement with the nozzle face of the printhead to seal the nozzle face while at the same instant, the nozzles eject a small amount of ink to increase the humidity in the environment of the cap. This prevents evaporation of the meniscus in the nozzles during the period of time that the printhead is in the capped condition.

For some systems, a dysfunctional effect of this humidification is a positive pressure buildup due to vapor pressure build up in the 70–100 mm Hg range. Temperature differentials may also results in positive pressure buildups in the cap of the same magnitude. With positive pressures of this magnitude, the capillary forces of the menisci in the nozzles are overcome and air is forced into the interior of the nozzles which may contribute to first print out problems. In extreme situations, the printhead ceases printing until an intervention in the form of priming or other recovery methods are used by the customer. The cap must be vented in some manner to rid these deleterious positive pressure buildups; typical solutions are to install valves to periodically release pressure or to reapply the cap sealing pressure on a periodic time schedule.

An associated problem is to maintain the capped printhead nozzle face in a relatively humid environment.

SUMMARY OF THE INVENTION

Certain printers use maintenance systems which include depositing ink that has been wiped from a nozzle face onto a collection member such as a blotter. According to the invention, for such systems, the above problems are alleviated by using the blotter member as a venting agent for the capped printhead with the collection member also being used to provide a certain amount of humidity. In a preferred embodiment, a wiper blade cleaning assembly and a capping/priming assembly are located in a maintenance station of an ink jet printer. The wiper blade assembly includes at least a wiper blade which is moved across the nozzle face of a printhead with ink residue from the blade being deposited onto an ink collection blotter. The capping assembly includes a cap which is pivotably mounted so as to make sealing contact with the nozzles in the printhead nozzle face. Pneumatic connections are provided between the cap assembly, the wiper blotter and a vacuum pump. When the capping assembly functions in a capping mode only (non-prime), a connection is open from the cap to the blotter so that the cap is vented to the atmosphere through a tortuous path that culminates in the blotter. During a priming operation, the connection to the blotter is closed, and a connection to a vacuum pump is opened enabling a priming vacuum pressure to be applied to the printhead.

More particularly, the present invention relates to a maintenance station for an ink jet printer, including:

- a wiping station for wiping a nozzle face of an ink jet printhead, said station including a blotter member for receiving ink residue wiped from said nozzle face,
- a capping assembly including a capping member for capping said nozzle face during a storage or priming mode,
- a vacuum source pneumatically connected along a first line to said blotter member and along a second line to said capping member and
- a control means for initiating a capping operation, with air being vented along said first line to said blotter member to the atmosphere, the control means initiating a priming operation by closing said first line to said blotter and connecting the capping member to the vacuum source via the second line.

DESCRIPTION OF THE INVENTION

Figure 1:
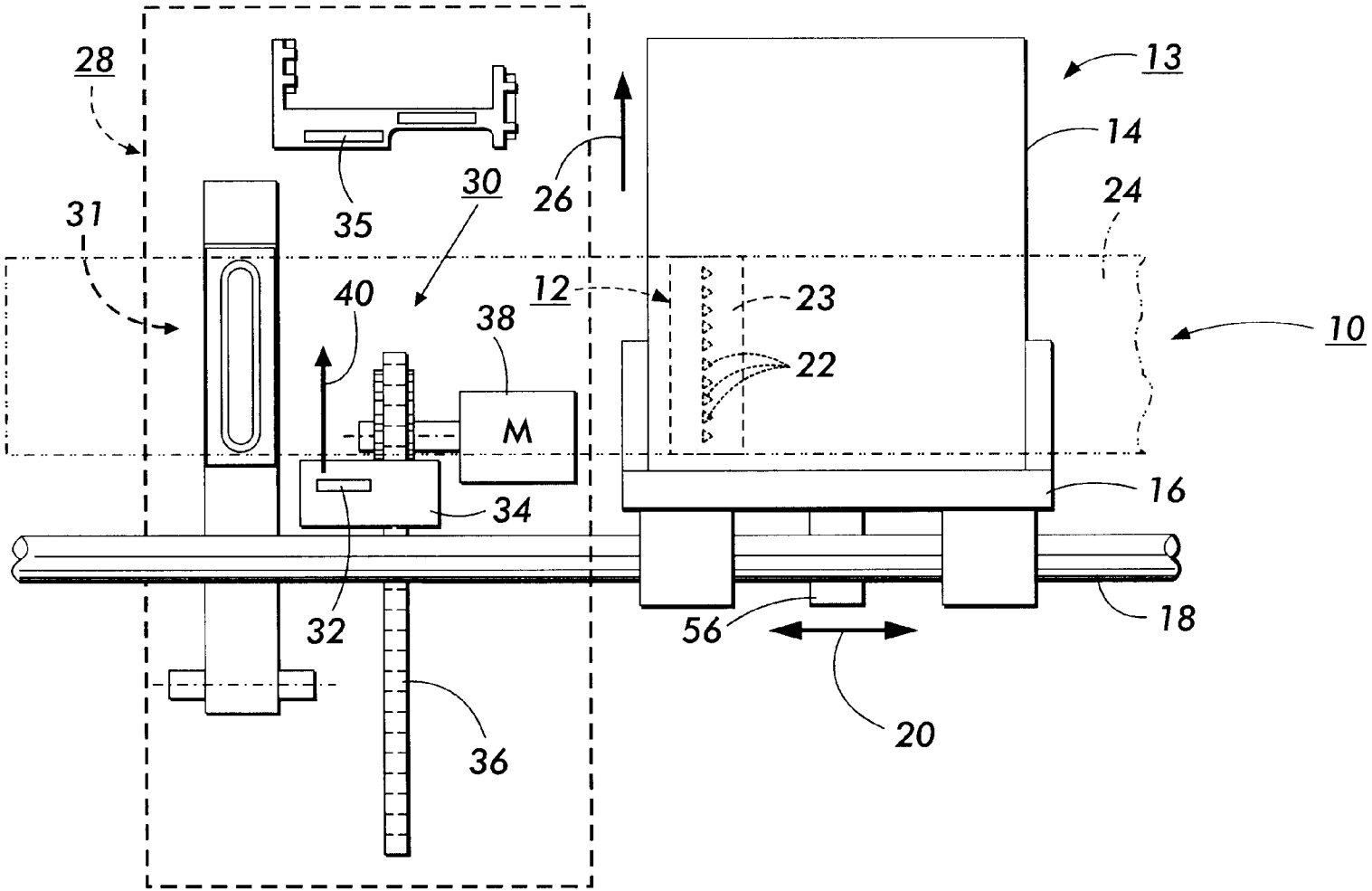
FIG. 1 is a schematic front elevational view of a partially shown ink jet printer having a wiping and capping assembly commonly and selectively connected to a vacuum source.

FIG. 1 shows a front elevational partial view of a thermal ink jet printer which incorporates the capping and blade cleaning system of the present invention. The printer shown is exemplary only, and the invention can be practiced in other types of ink ejecting print systems including, but not limited to, piezoelectric ink jet printers.

The printer 10 shown in FIG. 1 has a printhead 12, shown in dashed line, which is fixed to ink supply cartridge 14 and projects beyond the cartridge housing. The cartridge is removably mounted on carriage 16, and is translatable back and forth on guide rails 18 as indicated by arrow 20, so that the printhead and cartridge move concurrently with the carriage. The printhead contains a plurality of ink channels (not shown) which terminate in nozzles 22 in nozzle face 23 (both shown in dashed line) and carry ink from the cartridge to respective ink ejecting nozzles 22. When the printer is in the printing mode, the carriage translates or reciprocates back and forth across and parallel to a printing zone 24 (shown in dashed line) and ink droplets (not shown) are selectively ejected on demand from the printhead nozzles onto a recording medium (not shown), such as paper, in the printing zone, to print information thereon one swath at a time. During each pass or translation in one direction of the carriage 16, the recording medium is stationary, but at the end of each pass, the recording medium is stepped in the direction of arrow 26 for the distance of the height of one printed swath. For a more detailed explanation of the printhead and printing thereby, refer to U.S. Pat. Nos. 4,571,599 and Re. 32,572, incorporated herein by reference.

At one side of the printer, outside of the printing zone, is a maintenance station 28 which includes a blade cleaning assembly 30 and a capping assembly 31 where the printhead nozzle face can be capped and/or primed during non-print intervals. A maintenance station, which includes a wiping assembly and priming and capping assemblies is disclosed in, for example, U.S. Pat. No. 5,555,461, whose contents are hereby incorporated by reference.

Figure 2:
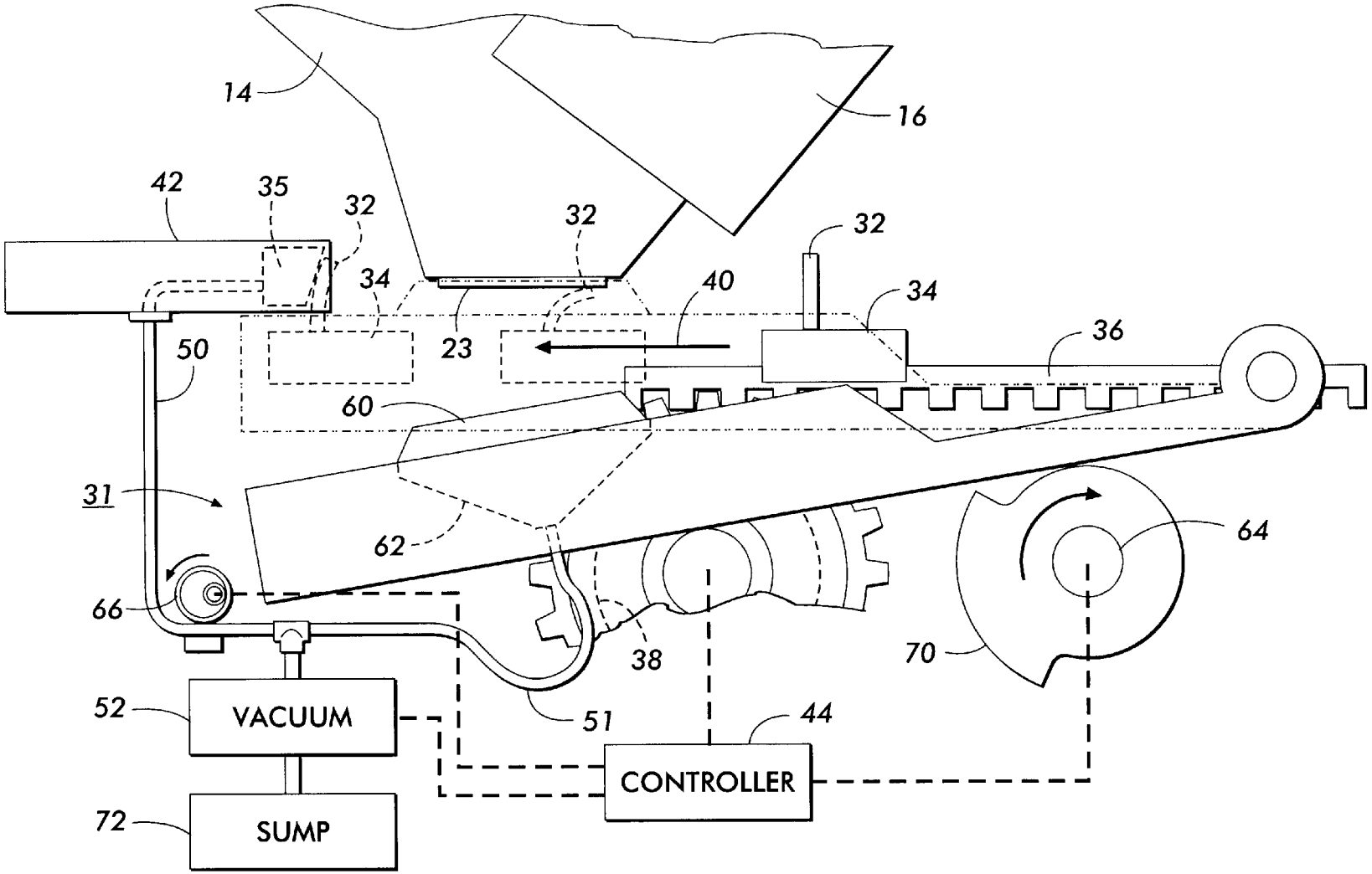
FIG. 2 is an end perspective view of the maintenance station shown in FIG. 1.
Figure 3:
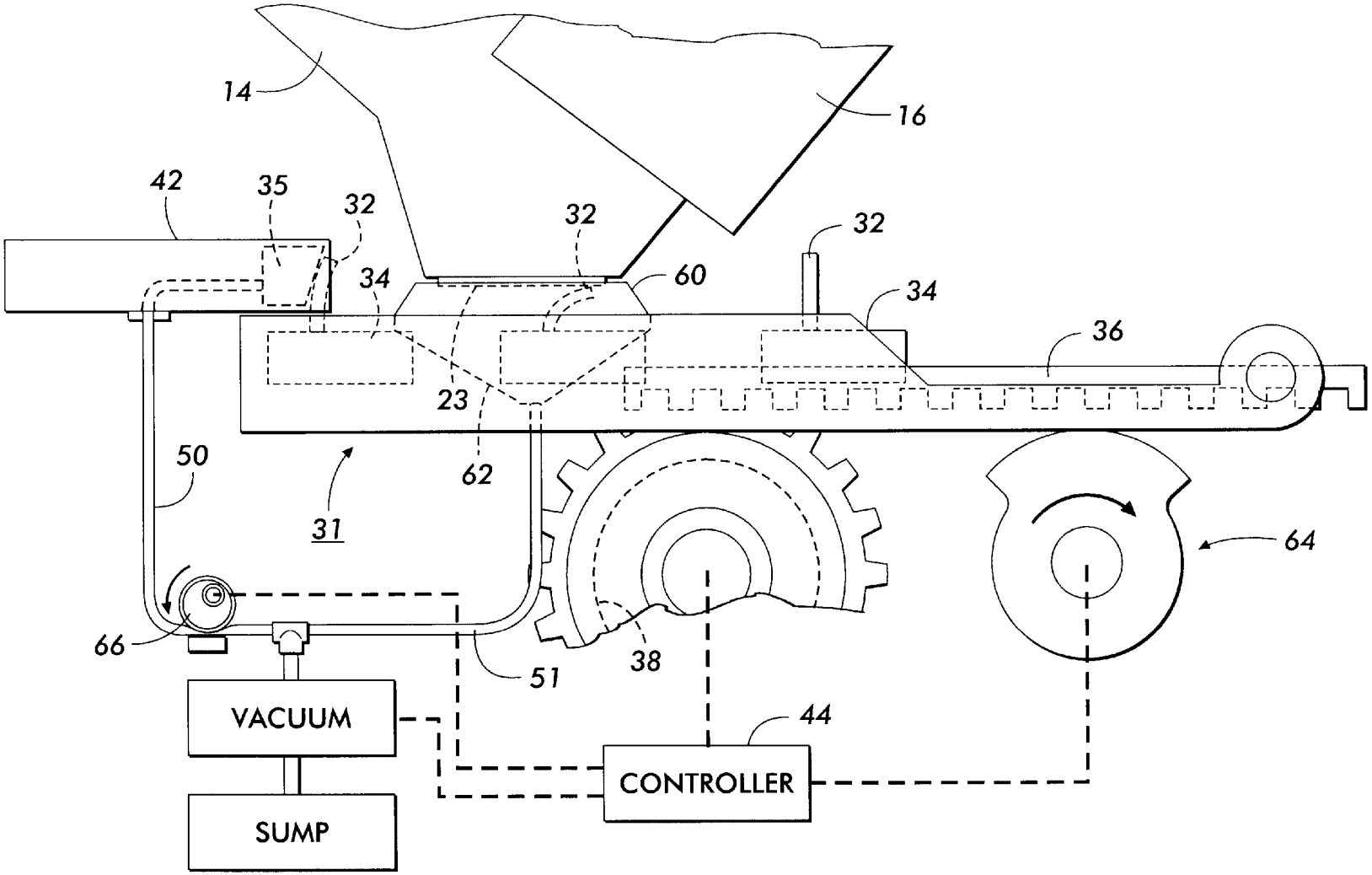
FIG. 3 shows a pneumatic connection of FIG. 2 established for a priming function.

Blade cleaning assembly 30, shown in schematic form, consists of a wiper blade 32 mounted on a movable member 34 and an ink collection member 35. Further details of assembly 30 are shown in FIG. 2. FIG. 2 is an end perspective view of maintenance station 28 following movement of carriage 16 into the maintenance station so as to position the nozzle face 23 into either a capping or a cleaning position. It is understood that a printhead cleaning or capping operation is periodically enabled by the system controller 44, typically at the end of a print operation. Blade movable member 34 is mounted on a rack and pinion device 36, which is operated conventionally by signals from the system controller. When the printhead is in a cleaning position, device 36 is actuated, moving member 34 and blade 32 in the direction of arrow 40. Collection member 35, mounted on holder 42, is aligned with blade 32 so as to capture ink wiped off nozzle face 23 and propelled thereon. Wiper blade 32 is shown in solid line at the start of a wipe operation and in dotted line midway and at the end of the wipe operation. Further details of the operation of blade cleaning assembly 30 is described in co-pending application U.S. Ser. No. 09/208220, filed Dec. 9, 1998, entitled "Wiper Blade Cleaning System", assigned to the same assignee as the present invention, and which is hereby incorporated by reference.

Turning now to the operation of capping assembly 31, assembly 31 includes a ribbed membrane 60 mounted to a tapered support manifold 62. An exemplary embodiment of a capping assembly is described in U.S. Ser. No. 09/208214, filed Dec. 9, 1998, entitled "Capping Assembly For An Ink Jet Printhead" assigned to the same assignee as the present invention, and which is hereby incorporated by reference. FIG. 2 shows the assembly in a lowered, non-capping position. At periodic intervals, it is desired to either cap the printhead to maintain the nozzles in a protected humid environment or to clean the nozzles and ink channels by a priming process whereby resistor heaters in the printhead are pulsed to cause ink to be ejected from associated channels and nozzles. Upon commands from the system controller 44, cartridge 14 is moved into station 28, and capping assembly 31 is rotated clockwise by operation of cam 64 upon receiving signals from controller 44. Ribbed membrane 60 is brought into contact with, and overlies, nozzle face 23.

Once the cap membrane is brought into contact with the nozzle face, either a capping operation or a priming operation can be performed.

Assuming the printhead is to be maintained for a period of time in a capped position, the cap is vented to the atmosphere along lines 51 and 50 and then through blotter 35 which, in a preferred embodiment, is a porous, sintered polypropylene. Thus, the blotter provides a tortuous path acting as an air vent and also contributes to humidification of the cap nozzle face by virtue of ink deposited in the blotter following a wiping operation. In effect, blotter 35 acts as a relief valve relieving pressure buildup caused by vapor pressure and temperature changes. Pressure buildup in the cap due to vapor pressure or temperature increase is known to deprime the nozzles by forcing air back through ink channels. The blotter humidity is periodically replenished following blade wiping cycles.

If the printhead is to be primed, full vacuum force of the vacuum source needs to be applied to the cap. According to another aspect of the invention, a pinch valve 66 is activated by signals from controller 44. Valve 66 is moved against line 50 shutting off line 50 to the blotter allowing a full vacuum to be applied to the cap via line 51. Heater resistors of printhead 12 are pulsed, causing ink to be ejected through nozzles 22 into the cap support manifold 62. Upon release of pinch valve 66, line 50 opens and ink is withdrawn into sump 50.

From the above, it is seen that connecting the blotter and cap assembly to a common vacuum source enables these three functions to be accomplished; to draw ink out of the blotter following a wipe or purge operation, to establish a capping pressure with a tortuous vent path which retards humidity diffusion, and to establish a priming pressure at the cap during a priming operation.

While the embodiment disclosed herein is preferred, it will be appreciated from this teaching that various alternative, modifications, variations or improvements therein may be made by those skilled in the art, which are intended to be encompassed by the following claims:

What is claimed is:

1. A maintenance station for an ink jet printer, including:

a wiping station for wiping a nozzle face of an ink jet printhead, said station including a blotter member for receiving ink residue wiped from said nozzle face, a capping assembly including a capping member for capping said nozzle face during a storage or priming mode, a vacuum source pneumatically connected to said blotter member and to said capping members, and control means initiating a capping operation, with air being vented to said blotter member to the atmosphere, the control means initiating a priming operation by closing said pneumatic connection between said vacuum source and said blotter and opening said pneumatic connection between the capping member and the vacuum source.

2. The station of claim 1 further including:

control means for initiating a priming operation whereby said control means causes ink to be ejected from nozzles in said nozzle face into said capping assembly.

3. An ink jet printer including:

an ink jet cartridge including an ink supply fluidly connected to a printhead having a plurality of nozzles for ejecting ink from a nozzle face, a carriage for moving said cartridge bi-directionally during a print mode and into a maintenance station, the maintenance station including:

a wiping station for wiping a nozzle face of an ink jet printhead, said station including a blotter member for receiving ink residue cleaned from said nozzle face, a capping assembly including a capping member for capping said nozzle face during a storage or priming mode, a vacuum source pneumatically connected to said blotter member and to said capping member and a control means for initiating a capping operation whereby the cap is vented to said blotter member to the atmosphere, the control means initiating a priming operation by closing said pneumatic connection between said vacuum source and said blotter member and opening said pneumatic connection between the capping member and the vacuum source.

* * * * *